US007946209B2

(12) United States Patent
Schneider et al.

(10) Patent No.: US 7,946,209 B2
(45) Date of Patent: May 24, 2011

(54) LAUNCHER FOR A PROJECTILE HAVING A SUPERCAPACITOR POWER SUPPLY

(75) Inventors: Arthur Schneider, Tucson, AZ (US); Jeffrey S. Supp, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 869 days.

(21) Appl. No.: 11/867,413

(22) Filed: Oct. 4, 2007

(65) Prior Publication Data

US 2008/0105113 A1 May 8, 2008

Related U.S. Application Data

(60) Provisional application No. 60/828,199, filed on Oct. 4, 2006.

(51) Int. Cl.
*F41F 1/00* (2006.01)

(52) U.S. Cl. ..... 89/8; 89/6; 89/6.5; 89/1.8; 89/1.812; 124/3

(58) Field of Classification Search ..... 89/6, 6.5, 89/1.8, 1.812, 8; 124/3
See application file for complete search history.

(56) References Cited

U.S. PATENT DOCUMENTS 2,690,124 A * 9/1954 Melick ..... 102/380
3,038,384 A * 6/1962 Gaugler ..... 89/1.814
3,098,448 A * 7/1963 Gisser et al. ..... 102/276
3,568,601 A * 3/1971 Morrow ..... 102/215
3,844,217 A * 10/1974 Ziemba ..... 102/276
3,861,312 A * 1/1975 Held et al. ..... 102/208
3,964,395 A * 6/1976 Kaiser et al. ..... 102/218
3,967,557 A * 7/1976 Irish, Jr. ..... 102/216
3,986,457 A * 10/1976 Mountjoy et al. ..... 102/276
4,003,659 A * 1/1977 Conard et al. ..... 356/139.03
4,233,673 A * 11/1980 Cricchi et al. ..... 365/184
4,273,051 A * 6/1981 Stratton ..... 102/202.2
4,351,503 A * 9/1982 Drori ..... 244/3.24
4,408,734 A * 10/1983 Koreicho ..... 244/3.13
4,414,549 A * 11/1983 Wichmann ..... 342/16
4,445,435 A * 5/1984 Oswald ..... 102/215
4,516,743 A * 5/1985 Sweeney et al. ..... 244/3.13
4,644,864 A * 2/1987 Komorowski et al. ..... 102/215
4,728,057 A * 3/1988 Dunne ..... 244/3.16
4,737,028 A * 4/1988 Smith ..... 356/139.08
4,750,688 A * 6/1988 Davies ..... 244/3.11
4,767,209 A * 8/1988 Johnson ..... 356/141.3
4,917,014 A * 4/1990 Loughry et al. ..... 102/201
5,101,728 A * 4/1992 Frink ..... 102/209
5,117,732 A * 6/1992 Munzel et al. ..... 89/6.5
5,119,715 A * 6/1992 Porter et al. ..... 89/6.5
5,343,795 A * 9/1994 Ziemba et al. ..... 89/6.5
5,348,249 A * 9/1994 Gallivan ..... 244/3.11
5,372,334 A * 12/1994 Cuadros ..... 244/3.11
5,415,100 A 5/1995 Tolley
5,478,028 A * 12/1995 Snyder ..... 244/3.11
5,497,704 A * 3/1996 Kurschner et al. ..... 102/264
5,685,504 A 11/1997 Schneider et al.
5,878,977 A * 3/1999 Hosaka et al. ..... 244/3.13
5,896,106 A * 4/1999 Seidensticker et al. ..... 342/428
5,923,417 A * 7/1999 Leis ..... 356/141.1

(Continued)

*Primary Examiner* — Stephen M Johnson
*Assistant Examiner* — Michael D David
(74) *Attorney, Agent, or Firm* — Ingrassia Fisher & Lorenz, P.C.

(57) ABSTRACT

The present invention generally concerns systems and methods for supplying electric power using supercapacitors; and more particularly, representative and exemplary embodiments of the present invention generally relate to improved methods and systems for supplying power to a guided rocket.

18 Claims, 3 Drawing Sheets

U.S. PATENT DOCUMENTS 6,135,387 A * 10/2000 Seidel et al. ..... 244/3.15
6,170,377 B1 * 1/2001 Larsson et al. ..... 89/6.5
6,176,168 B1 * 1/2001 Keil et al. ..... 89/6.5
6,247,408 B1 * 6/2001 Andrejkovies et al. ..... 102/200
6,268,785 B1 * 7/2001 Kollman et al. ..... 336/83
6,557,450 B1 * 5/2003 Cox et al. ..... 89/6.5
6,614,012 B2 * 9/2003 Schneider et al. ..... 244/3.1
6,650,277 B1 * 11/2003 Wilkinson ..... 342/62
6,659,396 B1 * 12/2003 August ..... 244/45 R
6,666,123 B1 * 12/2003 Adams et al. ..... 89/6.5
6,675,715 B1 * 1/2004 Kolbli ..... 102/206
6,762,710 B2 * 7/2004 Wilkinson ..... 342/62
6,839,017 B1 * 1/2005 Dillman ..... 342/16
6,842,138 B1 * 1/2005 Wilkinson ..... 342/62
6,892,643 B2 * 5/2005 Jennings, III ..... 102/202.14
6,892,646 B1 * 5/2005 Zimmerman et al. ..... 102/293
7,077,045 B2 7/2006 Dietrich et al.
7,079,070 B2 * 7/2006 Kongelbeck et al. ..... 342/62
7,121,210 B2 * 10/2006 Steele ..... 102/211
7,506,586 B1 * 3/2009 Pereira et al. ..... 102/207
7,533,849 B2 * 5/2009 Zemany et al. ..... 244/3.16
7,565,795 B1 * 7/2009 Horn et al. ..... 60/200.1
7,591,225 B1 * 9/2009 Cope et al. ..... 102/221
7,654,186 B1 * 2/2010 Cope et al. ..... 89/6.5
7,679,423 B1 * 3/2010 Nichols ..... 327/365
2003/0221546 A1 12/2003 Adams et al.
2005/0126379 A1 * 6/2005 Pikus et al. ..... 89/6

* cited by examiner

LAUNCHER FOR A PROJECTILE HAVING A SUPERCAPACITOR POWER SUPPLY

RELATED APPLICATIONS

This application claims the benefit of U.S. Provisional Patent Application Ser. No. 60/828,199 filed in the U.S. Patent and Trademark Office on Oct. 4, 2006.

FIELD OF INVENTION

The present invention generally concerns systems and methods for supplying electric power; and more particularly, representative and exemplary embodiments of the present invention generally relate to improved methods and systems for supplying power to a guided rocket.

BACKGROUND OF INVENTION

Guided missile technology has advanced to increase the lethality of weapons and advance the protection of those firing the weapon. "Fire-and-forget" is just one of the evolving methods of missile guidance. The military uses the term "fire-and-forget" for a type of missile which does not require further guidance after launch and can hit its target without the launcher being in the line of sight of the target. This may be a desirable property for a projectile to have, since a user or vehicle that lingers near a target to guide the missile (e.g., using a laser designator to paint the target) is vulnerable to attack and may be unable to carry out other tasks. Other advances along these lines (e.g., lock-on-before-launch, and/or the like) further expand this arena of technology.

Guided rockets have conventionally relied on a thermal battery with an inertial switch for their guidance needs. In these batteries, the electrolyte is usually stored separately from the electrodes which remain in a dry inactive state. The battery is generally only activated when it is actually needed by introducing the electrolyte into the active cell area and elevated to high temperatures by the application of heat from an external source. Though this process happens quickly, due to the speeds associated with rocket firings, every fraction of a second makes a significant difference in the arming and targeting of the rocket. This delay in battery readiness leads to shortened target acquisition time and increased firing distances.

Thermal batteries experience very little leakage over their lifetime, but are generally only rated for ten years of storage; however, desired storage needs typically exceed 15 years in many applications. Accordingly, there exists a need for a system design that overcomes these and other deficiencies associated with the prior art.

SUMMARY OF THE INVENTION

In various representative aspects, the present invention provides a design for a power system. Advantages of the present invention will be set forth in the Detailed Description which follows, and may be apparent from the Detailed Description or may be learned by practice of exemplary embodiments of the invention. Still other advantages of the invention may be realized by means of any of the instrumentalities, methods, or combinations particularly pointed out in the claims.

BRIEF DESCRIPTION OF THE DRAWINGS

Representative elements, operational features, applications and/or advantages of the present invention reside inter alia in the details of construction and operation as more fully hereafter depicted, described and claimed—reference being made to the accompanying drawings forming a part hereof, wherein like numerals refer to like parts throughout. Other elements, operational features, applications and/or advantages will become apparent in light of certain exemplary embodiments recited in the detailed description, wherein:

Figure 1:
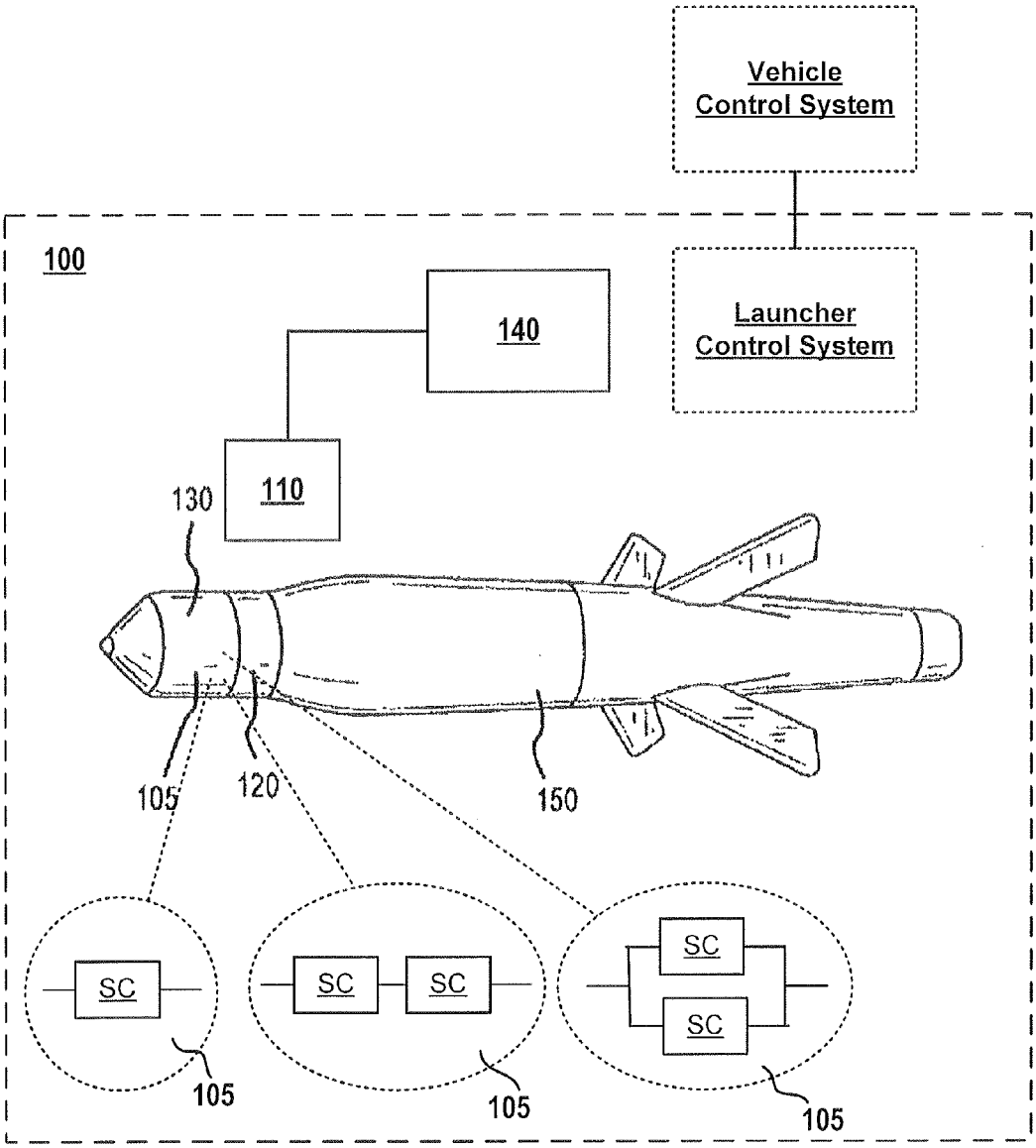
FIG. 1 representatively illustrates an isometric perspective view of a projectile launcher in accordance with an exemplary embodiment of the present invention.

Elements in the figures are illustrated for simplicity and clarity and have not necessarily been drawn to scale. For example, the dimensions of some of the elements in the Figures may be exaggerated relative to other elements to help improve understanding of various embodiments of the present invention. Furthermore, the terms "first", "second", and the like herein, if any, are used inter alia for distinguishing between similar elements and not necessarily for describing a sequential or chronological order. Moreover, the terms "front", "back", "top", "bottom", "over", "under", "forward", "aft", and the like in the description and/or in the claims, if any, are generally employed for descriptive purposes and not necessarily for comprehensively describing exclusive relative position. Any of the preceding terms so used may be interchanged under appropriate circumstances such that various embodiments of the invention described herein, for example, may be capable of operation in other configurations and/or orientations than those explicitly illustrated or otherwise described.

DETAILED DESCRIPTION OF EXEMPLARY EMBODIMENTS

The following representative descriptions of the present invention generally relate to exemplary embodiments and the inventors' conception of the best mode, and are not intended to limit the scope, applicability or configuration of the invention in any way. Rather, the following description is intended to provide convenient illustrations for implementing various embodiments of the invention. Changes may be made in the function and/or arrangement of any of the elements described in the disclosed exemplary embodiments without departing from the spirit and scope of the invention.

The present invention is described partly in terms of functional components and various processing steps. Such functional components and processing steps may be realized by any number of components, operations, and techniques configured to perform the specified functions and achieve the various results. For example, the present invention may employ various elements, materials, processors, communication techniques, communication devices, launching devices, and winding methods and the like, which may carry out a variety of functions. In addition, although the invention may be described in a relational context, the present invention may be practiced in conjunction with any number of applications, environments, and compatible processes. Accordingly, the systems described are merely exemplary applications for the invention.

Methods and apparatus according to various aspects of the present invention comprise an inductive power transfer system using an induction transformer. Various representative implementations of the present invention may be applied to any inductive power transfer system. Certain representative implementations may include, for example: a projectile arming and power system suitably configured for any projectile dimension; transformer windings fabricated from any suitable material; modification of the design of the winding elements; and/or the like. The present invention may provide a primary arming and power method or may be utilized as a stand-alone or as one of many secondary power and arming devices. Alternatively, conjunctively or sequentially, the present invention may provide a primary power method, or may be utilized as a stand-alone, or as one of many secondary power devices.

A detailed description of an exemplary application, namely a system suitably configured for use with helicopter-based Advance Precision Kill Weapons System (APKWS) modified Hydra 70 type guided rockets, is provided as a specific enabling disclosure that may be generalized to any application of the disclosed system and method for arming and powering munitions in accordance with various embodiments of the present invention. Although the M61 nineteen (19) tube rocket launcher is provided as a specific enabling disclosure, the invention may be adapted to any apparatus designed to provide power and data transfer prior to launch. For example, referring to FIG. 1, in one embodiment in accordance with various aspects of the present invention, arming system 100 may include a projectile 150, at least one supercapacitor 105, a launcher winding 110, a projectile winding 120, an operations system 130, and a power source 140.

Supercapacitor 105 will generally be capable of supplying suitably conditioned power to the projectile during its flight. A supercapacitor is an electrochemical capacitor that has a higher energy density as compared with traditional capacitors. Electronic control and switching equipment may be employed to assist in storing and recovering the energy in the supercapacitor due to the varied voltages stored. The supercapacitor may be constructed using carbon nanotubes, carbon aerogels, or other similar suitable materials. Such other materials may include, for example, those that efficiently increase the available surface area of the electrodes. Supercapacitor technology is continuously evolving to make the devices smaller with higher energy storage capabilities. Accordingly, it will be appreciated that any supercapacitor device or device element, whether now known or hereafter described in the art, may be used.

In a representative embodiment, supercapacitor 105 may be configured or otherwise provide a capability of storing at least 350 watt seconds of energy, or a current of approximately 19.4 amps, for approximately 18 seconds. Although configuring supercapacitor 105 in parallel is possible, arranging at least two (2) supercapacitors 105 in series may provide a configuration that permits the efficient delivery of approximately 38.8 watts of power at approximately 5 volts for about 18 seconds. Supercapacitor 105 may be suitably sized to fit the design characteristics of its mounting environment. In a representative embodiment, supercapacitor 105 may be housed within the projectile body. In another representative embodiment, supercapacitor 105 may have an approximate diameter of 25 mm.

Supercapacitor 105 may be able to receive power from the launcher. This may be performed through physical electrical connections or through other means of transferring power. Supercapacitor 105 may also serve as the power source for transmitting data to the launcher.

In a representative embodiment, supercapacitor 105 may be electrically connected to projectile winding 130 and charged through induction. Supercapacitor 105 may be charged while loaded in a launcher or prior to being loaded in a launcher.

In a representative and exemplary application, at least one supercapacitor 105 may be electrically connected to projectile winding 120. When magnetically connected to another winding, an induction transformer may be formed. In a representative embodiment, an induction transformer may be produced when projectile winding 120 is combined with launcher winding 110. Projectile winding 120 may be fabricated from any suitable transformer winding material. Additionally, any suitable number of windings, turns, or coils may be implemented to realize a suitably configured induction transformer. Projectile winding 120 may be external to the projectile or located within the body of the projectile. In a representative embodiment, the projectile winding may be located in the body of the projectile so that when loaded into the launcher, the projectile winding may be suitably positioned to magnetically form an induction transformer with launcher winding 110.

In a representative and exemplary embodiment, launcher winding 110 may be suitably positioned to magnetically form an induction transformer with at least one projectile having at least one projectile winding 120. Launcher winding 110 may be fabricated from any suitable material to form an induction transformer. Any suitable number of windings, turns, or coils may be implemented to complete the induction transformer. The induction transformer may be disposed in any position on or around the launcher that is suitably configured to permit the induction transformer to transfer current by inductance to a projectile. In a representative embodiment, launcher winding 110 may be implemented on a hydra 70 helicopter launcher platform. Launcher winding 110 may be attached to the launcher by a circumferential strap so that no costly modifications will generally be needed to the existing launcher platform. Launcher winding 110 may be located towards the front of the launcher so that at least one of the projectiles, within the launcher housing, will form an induction transformer with the launcher winding 110. The resulting induction transformer may be employed as the primary method for data and power transfer or may comprise a secondary device. In one representative embodiment, launcher winding 110 may be electrically connected to the 1760 data bus of the helicopter for power and data transfer. Additionally, launcher winding 110 may be configured to induce a current in multiple projectiles adapted with projectile winding 120 concurrently.

The operations system 130 may be capable of receiving, transmitting, and storing data related to the arming and firing of the projectile. This data may include, but is not limited to: projectile targeting data, projectile guidance data, laser codes, bit-checks, projectile status data, and/or the like. Operations system 130 will generally transfer data from projectile 150 to the launcher control system. Additionally, operations system 130 may be capable of receiving data from the launcher control system. This transfer of data may be performed using wired or through wireless coupling. Operations system 130 may be suitably electrically coupled to at least one projectile 150 and may be mounted within the projectile 150 or suitably electrically coupled to projectile 150. In a representative embodiment, operations system 130 may be located in a forward section of an adapted Hydra 70 type missile. The operations system 130 may be suitably electrically coupled to the launcher control system. In a representative embodiment, transfer of data may be accomplished through modulating the inductive current through the projectile winding 120 and launcher winding 110 to the control system of the launcher. In another representative embodiment, operations system 130 may able to transmit and receive "lock-on-before-launch" information. The control system of the launcher may be located in the cockpit of a helicopter, the display of a shoulder fired rocket, and/or the like.

Operations system 130 may receive commands transmitted from the control system of the launcher. In a representative and exemplary embodiment, these commands may be directed from the cockpit of the helicopter operator. The commands may comprise targets designated by a laser. Operations system 130 may be electrically coupled to at least one laser seeker. Laser seekers may be located on the projectile nose or mounted elsewhere on the projectile. Multiple seekers may work in tandem towards a common goal or unitary result. The projectile may be adapted to track the target prior to launch once the operations seeker is powered. In a representative embodiment, the seeker may be available once supercapacitor 105 has been charged; unlike the longer lag time associated with an inertial switch activated thermal battery.

A representative and exemplary embodiment may employ a distributed aperture semi-active laser seeker. When the operator receives a signal that the operations seeker is in tracking mode, the operator pushes the fire button and the projectile is launched towards the target in tracking mode. Supercapacitor 105 may be used as the power source of the guidance system of the projectile. Multiple projectile seekers may track at least one target at one time.

Power source 140 may be used to power at least one supercapacitor 105. In a representative embodiment, this coupling may be accomplished through the launcher winding 110 and the projectile winding 120 that comprise the induction transformer, :In representative and exemplary application, the power source 140 coupling may be facilitated through an electrical coupling to the 1760 data bus of the helicopter.

Figure 2:
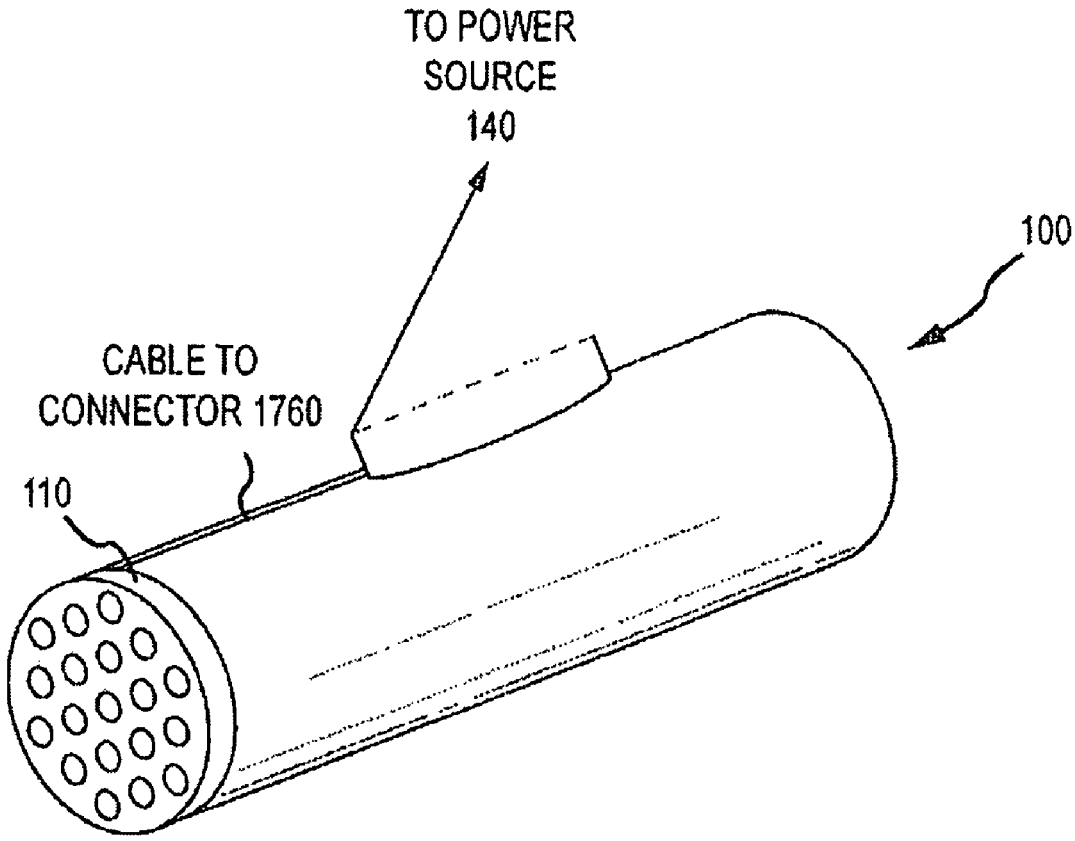
FIG. 2 representatively illustrates an isometric perspective view of a projectile launcher in accordance with an exemplary embodiment of the present invention.

Referring to FIG. 2, a representative embodiment of the present invention may include an adaptation of a modified Hydra 70 type guided missile. The missile may be fitted with a forward portion containing at least one projectile winding 120, at least one supercapacitor 105, and operations system 130 within the missile body. The location of the projectile winding 120 may be such that it forms an induction transformer with launcher winding 110.

Arming system 100 increases protection for the shooter and increases lethality of the munition. The traditional projectile powering technique, a thermal battery, may be considerably more costly than a supercapacitor and its available energy may be slowed by the thermal battery activation process. The time required for arming is an important consideration given the traditionally short flight time of the projectile.

Targeting and flight control operations may begin once the power system of the projectile 150 is available. In a representative and exemplary embodiment, the arming of the projectile may occur within milliseconds. A decrease in kill range is generally available due to the decreased arming time. The fuse in the warhead responds to the boost acceleration and arms the warhead. An arming delay may be required to protect against the warhead damaging the launcher upon detonation.

Arming system 100 may also allow for the transfer of data related to multiple future targets prior to firing. This will further protect the user as the time required to be spent in hostile conditions may be reduced. Arming system 100 generally extends the shelf life for missiles as this technology surpasses the expected operational life span of traditional thermal batteries.

Figure 3:
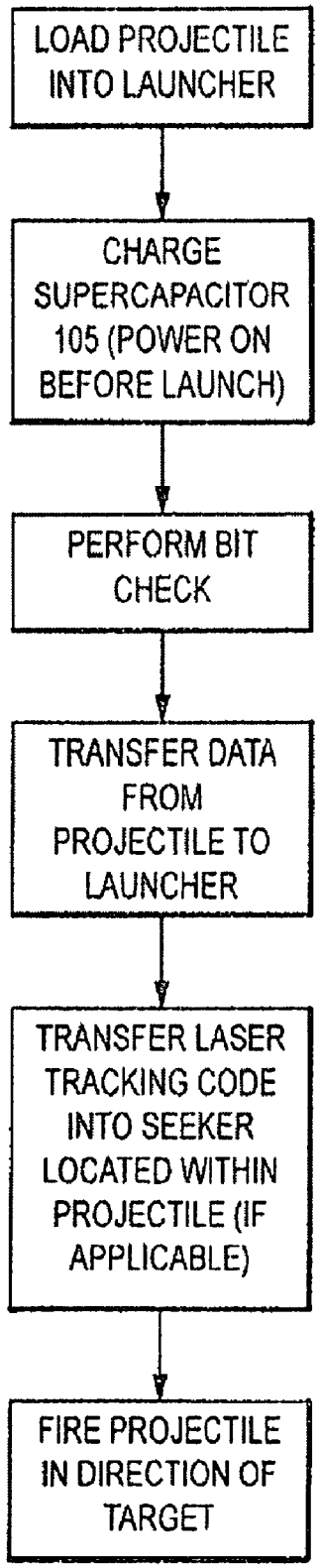
FIG. 3 representatively illustrates an operational flowchart in accordance with an exemplary embodiment of the present invention.

Referring to FIG. 3, in a representative embodiment, a missile fitted with an internal projectile winding 120 may be loaded into a launcher adapted with a launcher winding 110. The missile's internal supercapacitor 105 may be charged through induction. This may be performed by the induction transformer produced between the projectile winding 120 and the launcher winding 110 or a secondary charging mechanism. Projectile winding 120 and launcher winding 110 of the transformer may be electrically isolated from each other. The transfer of energy takes place by electromagnetic coupling through a process known as mutual induction. The current may be modulated by the operations system 130 as needed to suitably transmit data. This data may comprise at least one of: flight information, targeting information, missile status information and guidance information. The current sent through induction from the launcher winding 110 to the projectile winding 120 may be supplied from the 1760 data and power system of the helicopter. The current sent from the projectile winding 120 to the launcher winding 110 may be delivered from the supercapacitor 105 located within the projectile body. This process may be repeated for any number of projectiles housed within the launcher. A plurality of projectiles may be charged at once or discrete projectiles may be charged individually. Constraints of the power source may determine how many projectiles may be charged simultaneously. In a representative embodiment, utilization of an adapted nineteen (19) tube launcher with two charging sessions may be preformed, though more or less sessions may be preformed if all tubes on the launcher are loaded. Post charging, the projectile may be fired in the direction of the target.

In the foregoing specification, the invention has been described with reference to specific exemplary embodiments; however, it will be appreciated that various modifications and changes may be made without departing from the scope of the present invention as set forth in the claims below. The specification and figures are to be regarded in an illustrative manner, rather than a restrictive one and all such modifications are intended to be included within the scope of the present invention. Accordingly, the scope of the invention should be determined by the claims appended hereto and their legal equivalents rather than by merely the examples described above.

For example, the steps recited in any method or process claims may be executed in any order and are not limited to the specific order presented in the claims. Additionally, the components and/or elements recited in any apparatus claims may be assembled or otherwise operationally configured in a variety of permutations to produce substantially the same result as the present invention and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required, or essential features or components of any or all the claims.

As used herein, the terms "comprising", "having", "including", or any contextual variant thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied, or otherwise particularly adapted to, specific environments, manufacturing specifications, design parameters or other operating requirements without departing from the general principles of the same.

We claim:

1. A device for launching a projectile that comprises a supercapacitor power supply, the device comprising:

a launcher configured to launch the projectile;

a power source;

launcher windings; and a launcher control system in communication with an operations system of a vehicle and configured to communicate with the projectile to thereby:

receive data transmitted to the projectile during operation of the vehicle, wherein the data comprises a laser tracking code for a seeker located within the projectile;

power on the projectile for launching;

charge the supercapacitor in the projectile from the power source via the launcher windings;

transfer the laser tracking code to the projectile via the launcher windings after powering on the projectile for launching; and after charging the supercapacitor in the projectile and transferring the code for the seeker, launch the projectile with the launcher.

2. The device for projectile launching according to claim 1, wherein the projectile transmits data to the launcher by modulating current induced in the launcher windings from the projectile after the projectile is powered on for launching.

3. The device for projectile launching according to claim 1 wherein the projectile comprises a projectile winding in proximity to the launcher winding when the projectile is housed within the launcher.

4. The device for projectile launching according to claim 3 wherein the launcher is configured to receive data from the projectile through a current induced in the launcher winding by the projectile winding.

5. The device for projectile launching according to claim 3 wherein the data received from the projectile comprises projectile system status information.

6. The device for projectile launching according to claim 1, wherein the projectile comprises multiple supercapacitors implemented in parallel.

7. The device for projectile launching according to claim 1 wherein the projectile comprises multiple supercapacitors implemented in series.

8. The device for projectile launching according to claim 1 wherein the launcher control system is further configured to perform a hit check after powering on the projectile for launching and before launching the projectile.

9. The device for projectile launching according to claim 1, wherein the launcher control system is configured to charge the supercapacitor in the projectile from the power source via the launcher windings after the projectile is powered on for launching and prior to launching the projectile.

10. A device for launching a projectile comprising a seeker and a supercapacitor power supply, the device comprising:

a launcher configured to launch the projectile;

a power source;

launcher windings; and a launcher control system configured to communicate with the projectile and with an operations system of a vehicle to thereby receive data comprising a laser tracking code for the seeker during operation of the vehicle, to power on the projectile for launching, to charge the supercapacitor in the projectile from the power source via the launcher windings, to transfer the data comprising the laser tracking code to the projectile via the launcher windings after powering on the projectile for launching, and, after charging the supercapacitor in the projectile and transferring the laser tracking code for the seeker, to direct the launcher to launch the projectile.

11. The device for projectile launching according to claim 10, wherein the projectile transmits data to the launcher by modulating current induced in the launcher windings from the projectile after the projectile is powered on for launching.

12. The device for projectile launching according to claim 10 wherein the projectile comprises a projectile winding in proximity to the launcher winding when the projectile is housed within the launcher.

13. The device for projectile launching according to claim 12 wherein the launcher is configured to receive data from the projectile through a current induced in the launcher winding by the projectile winding.

14. The device for projectile launching according to claim 13 wherein the data received from the projectile comprises projectile system status information.

15. The device for projectile launching according to claim 10, wherein the projectile comprises multiple supercapacitors implemented in parallel.

16. The device for projectile launching according to claim 10 wherein the projectile comprises multiple supercapacitors implemented in series.

17. The device for projectile launching according to claim 10 wherein the launcher control system is further configured to perform a bit check after powering on the projectile for launching and before launching the projectile.

18. The device for projectile launching according to claim 10, wherein the launcher control system is configured to charge the supercapacitor in the projectile from the power source via the launcher windings after the projectile is powered on for launching and prior to launching the projectile.

* * * * *